United States Patent [19]

Errani

[11] Patent Number: 4,683,740

[45] Date of Patent: Aug. 4, 1987

[54] CYLINDER LOCK WITH KEY, INCORPORATING A PICKING PREVENTING MEANS

[75] Inventor: Deo Errani, Faenza, Italy

[73] Assignee: Costruzioni Italiane Serrature Affini C.I.S.A. S.p.A., Faenza RA, Italy

[21] Appl. No.: 737,594

[22] Filed: May 24, 1985

[30] Foreign Application Priority Data

Jun. 1, 1984 [IT] Italy ..... 3482 A/84

[51] Int. Cl.[4] ..... E05B 15/06

[52] U.S. Cl. ..... 70/419; 70/364 A; 70/420; 70/421

[58] Field of Search ..... 70/419–421, 70/407, 409, 364 A

[56] References Cited

U.S. PATENT DOCUMENTS

| | | | |
|---|---|---|---|
| 2,049,548 | 8/1936 | Swanson | 70/364 A |
| 3,045,468 | 7/1962 | Welch et al. | 70/421 |
| 3,777,520 | 12/1973 | Crepinsek | 70/364 A X |
| 3,974,670 | 8/1976 | Wolter | 70/421 X |
| 4,221,121 | 9/1980 | Tietz | 70/421 X |
| 4,320,638 | 3/1982 | Dunphy et al. | 70/364 A X |
| 4,321,811 | 3/1982 | Ziegler | 70/364 A X |

FOREIGN PATENT DOCUMENTS

| | | | |
|---|---|---|---|
| 367684 | 1/1923 | Fed. Rep. of Germany | 70/364 A |
| 1061651 | 7/1959 | Fed. Rep. of Germany | 70/364 A |
| 1157960 | 11/1963 | Fed. Rep. of Germany | 70/364 A |
| 2909894 | 9/1980 | Fed. Rep. of Germany | 70/409 |
| 48209 | 11/1939 | Netherlands | 70/364 A |
| 257342 | 10/1948 | Switzerland | 70/364 A |

*Primary Examiner*—Robert L. Wolfe
*Assistant Examiner*—Lloyd A. Gall
*Attorney, Agent, or Firm*—Guido Modiano; Albert Josif

[57] ABSTRACT

A cylinder lock with key, incorporating a picking preventing means, comprises a plug mounted rotatably within the cylindrical seat of a lock cylinder and has a first set of holes lying on a radial plane. The holes accommodate pins which cooperate with tumbler pins accommodated in a second set of holes formed in the cylinder and being aligned with the first set of holes. A longitudinal key slot extends through the plug which is in communication with the first set of holes and has a longitudinal rib arranged to project thereinto to provide support for the pins. The rib conceals the ends of the pins resting thereon, and defines an intersection of the longitudinal key slot with the cylindrical portions of said first set of holes accommodating said pins. One of the pins has the same length as the hole accommodating it, thereby if deceitfully shifted, it will unavoidably engage the hole of the respective tumbler pin and produce a locked condition of the lock.

3 Claims, 7 Drawing Figures

CYLINDER LOCK WITH KEY, INCORPORATING A PICKING PREVENTING MEANS

BACKGROUND OF THE INVENTION

This invention relates to a cylinder lock with key, incorporating a picking preventing means.

As is known, cylinder locks generally comprise a plug carried rotatably within a seat formed in the lock cylinder or body and being rotatively connected to a so-called bit. The plug has, on a radial plane thereof, a set of holes which accommodate pins of a shorter length than the holes and adapted to cooperate with respective tumbler pins accommodated in a second set of holes formed in the lock cylinder and being spring biased.

With the key removed, owing to the bias force of the springs, some pins are allowed to partly penetrate the pin holes to inhibit rotation of the plug.

The plug holes are put into communication with the key slot, and the notches of the key are related to the length of the pins such that, on inserting the key, the contact points between the pins and mating tumbler pins will lie on the shearing plane between the plug and cylinder of the lock, thus allowing the plug, and hence the bit, to be rotated.

With prior cylinder locks, picking efforts are mainly directed to surreptitiously produce alignment on the shearing plane of the plug pins and tumbler pins using such special implements as picking tools. Attempts of this kind are favored by the key slot being coplanar with the pin holes, thereby permitting the insertion of a lock picking tool through the key slot, enabling one to act axially on the pins and selectively move them over a sufficient distance to allow the plug to be turned.

In order to resist tampering as far as possible, it has been proposed to provide a cylinder lock having a key slot with suitably offset and shaped longitudinal ribs to interfere with pin manipulation. However, due to reasons of manufacture, and mechanical strength requirements of the key itself, the key slot is still made too large to effectively discourage such picking efforts as described above.

From the U.S. Pat. No. 2,049,548 it is also known to provide a longitudinal rib in the key slot on which the pins of the plug rest with their inner ends. However, also this lock is susceptible to pin manipulation since picking tools may be introduced from the side under the pins and raise the latter in the plug rotating position.

SUMMARY OF THE INVENTION

Accordingly, it is a primary object of this invention to provide a cylinder lock, and related key, wherein the mechanical action by deceitful means on the pins can be effectively counteracted.

A further object of the invention is to provide such a lock and related key, which can be manufactured by conventional methods, to result in a final product which fills the requisite for commercial competitiveness and can meet with increased acceptance by virtue of its superior safeguarding features.

These objects are achieved by a cylinder lock with key comprising a plug and a lock cylinder including a cylindrical seat, said plug being mounted rotatably within the cylindrical seat and having a first set of holes lying on a radial plane, and pins in said first set of holes, said pins having ends and being adapted for cooperation with tumbler pins accommodatable in a second set of holes, formed in said lock cylinder, said first set of holes including cylindrical portions and being in communication with a longitudinal key slot, characterized in that said longitudinal key slot comprises a longitudinal rib, said longitudinal rib being adapted for engagement with said ends of said pins and defining an intersection of said longitudinal key slot with said cylindrical portions of said first set of holes.

According to another aspect of the invention, a key for operating a cylinder lock, is characterized in that it comprises a plug and a lock cylinder including a cylindrical seat, said plug being mounted rotatably within the cylindrical seat and having a first set of holes lying on a radial plane and pins in said first set of holes, said pins having ends and being adapted for cooperation with tumbler pins accommodatable in a second set of holes formed in said lock cylinder, said first set of holes including cylindrical portions and being in communication with a longitudinal key slot, said key being characterized in that it comprises a longitudinal portion lying on the same plane as said pins, a notched portion formed in conformity with lock coding requirements, and an opposed edge adapted for substantial alignment with a longitudinal rib projecting into said longitudinal key slot and defining a rest plane of said pins, said key comprising a further longitudinal portion, adapted to substantially surround said longitudinal rib and being connected to said notched portion by a web, said web being adapted to engage an intersection of said longitudinal key slot at said cylindrical portions of said first set of holes, said notched portion being provided with a bevel, said bevel lying at an acute angle to said opposed edge.

BRIEF DESCRIPTION OF THE DRAWINGS

Further features of this invention will be more readily understood from the following detailed description of some preferred embodiments thereof, with reference to the accompanying illustrative drawings, where.

DESCRIPTION OF THE PREFERRED EMBODIMENTS

Figure 1:
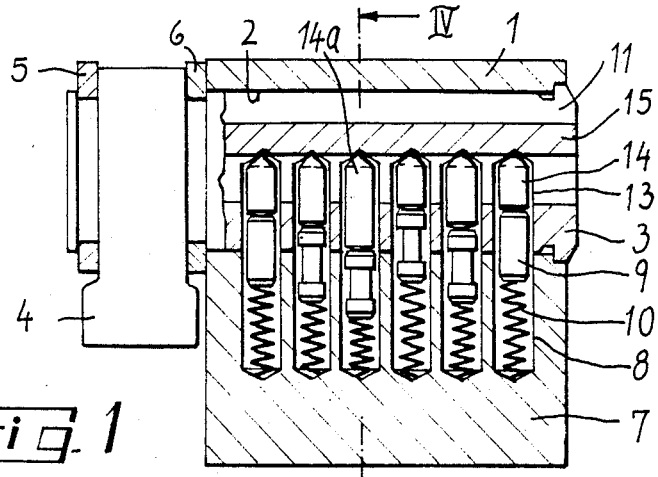
FIG. 1 is a longitudinal sectional view of the cylinder lock of this invention.

For convenience of illustration, the term "profile" refers hereinafter to the key cross-section and the term "coding" to the key notch shape.

The lock shown in FIGS. 1–6 comprises a cylinder or outer body 1 which encloses a cylindrical seat 2 wherein a plug 3 is received rotatably.

A bit 4 is rotatively coupled to the plug, the bit being held axially between two washers 5,6.

The body 1 has an expansion 7 wherein a number of blind holes 8 are formed, which lie on a longitudinal plane containing the axis of the cylindrical seat 2. The blind holes 8 accommodate tumbler pins 9 biased by springs 10 toward the plug 3.

The plug 3 is formed with a longitudinal key slot 11 to receive a key 12 therethrough, said longitudinal key slot intersects a set of radial holes 13 which, with the plug 3 at a preset angular position corresponding to the position of insertion/withdrawal of the key into/from the lock, is in alignment with the blind holes 8. The holes 13 accommodate pins 14 of different lengths conforming with the key coding, which pins lock and unlock the cylinder lock in cooperation with the tumbler pins 9. In fact, the holes 8 and 13 have the same diameter, so that the pins 14 and tumbler pins 9 can move into and out of them when aligned together. One of the pins 14, as designated with the reference character 14*a*, has the same length as the respective hole 13.

Projecting laterally into the key slot 11 is a longitudinal rib 15, which forms a rest shelf or abutment of sort for the pins 14 pushed thereagainst by the tumbler pins 9 biased by the springs 10 and whereat the bottoms of the holes 13 are located.

The rib 15 is configured to provide a ridge 16 which defines, in cooperation with the inner wall of the slot 11, a groove 17. The top of the ridge 16 intersects the cylindrical portion of the holes 13, and the bottom of the groove 17 is located substantially on the centerplane A of the plug 3.

The top of the ridge 16 and bottom of the groove 17 lie at different levels with respect to an ideal plane B containing the bottoms of the holes 13 and extending perpendicularly to the centerplane A of the plug. More specifically, the distance "a" to the top of the ridge 16 from the plane B is greater than the distance "b" to the bottom of the groove 17 from that same plane.

The pins 14 accommodated in the holes 13 are expediently formed with their ends, in contact with the tumbler pins 9, of crowned shaped and their opposed ends of conical shape, with the cone tip and peripheral edge thereof rounded off. The height "c" (FIG. 4) of said conical end is smaller than the distance "a" but larger than the distance "b", thereby with the pins 14 inserted into the holes 13, the bottom of the groove 17 will lie somewhere in between the tip and base of the conical end of the pin 14.

The rib 15 imparts to the key slot 11 a peculiar configuration including a zone 18 adapted to receive the key back side and opening toward the periphery of the plug 3 at a diametrically opposed location to the ports of the holes 13. The thickness of the zone 18 pattern diminishes substantially as far as the top of the ridge 16, where it forms an elbow 19 at the intersection of the slot 11 with the cylindrical portion of the holes 13. The elbow 19 communicates with a flattened zone 20 which extends substantially on the centerplane A and is adapted to receive the notched portion of the key.

The key 12 comprises a shank having a complementary profile to the key hole of the longitudinal key slot 11, and including a longitudinal portion 21 formed, along one edge, with notches 22 and having the opposed edge 23 adapted to slide along the bottom of the groove 17.

Laterally of the edge 23, there extends a web 24 joining the portion 21 to the longitudinal portion or back side 25 of the key. The web 24 is intended to engage with the elbow 19 at the intersection with the holes 13, while the back side 25 is received at the zone 18.

The notched portion 21 has at its free end a bevel 26 forming, with the edge 23, a wedge of sort whose tip, indicated at 27, is adapted for actuation of the pins 14.

This cylinder lock operates as follows.

In the inoperative condition, as shown in FIG. 1, the pins 14, owing to the bias force applied by the springs 10 to the tumbler pins 9, are pushed to rest against the rib 15 with their conical ends in contact with the bottoms of the holes 13, on the plane B. The plug is inhibited from rotation by the tumbler pins 9 engaging in the first set of holes 13.

On inserting the key 12 through the key slot 11, since the tip 27 will be positioned at the distance "b" from the plane B, i.e. between the tips and bases of the conical ends of the pins 14, the notched portion 21 can be introduced under the pins 14 such that, with the key fully inserted into the slot 11, the contact points of the pins 14 with the tumbler pins 9 will lie exactly on the shearing plane coincident with the surface of the plug 3, thus allowing the plug to be rotated and the bit engaged.

Thus, from the above standpoint, this lock may be regarded as operating like any ordinary cylinder lock.

Figure 3:
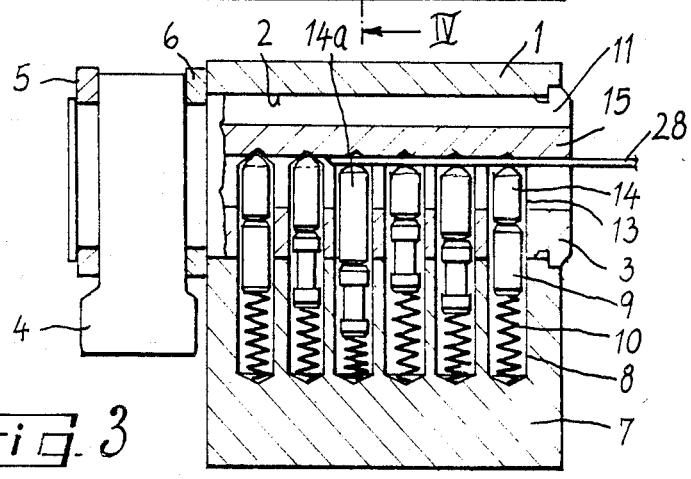
FIG. 3 is a longitudinal sectional view of the cylinder lock illustrated in FIG. 1, illustrating how the action of a lock picking tool affects this cylinder lock.
Figure 2:
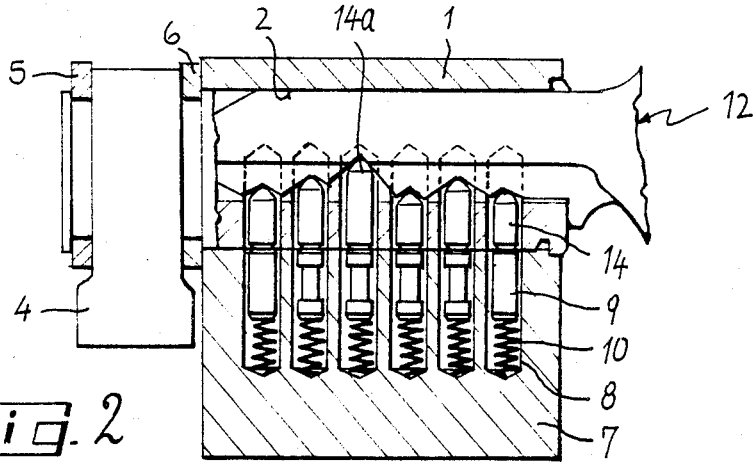
FIG. 2 is a longitudinal sectional view of the cylinder lock illustrated in FIG. 1 with the key inserted thereinto.
Figure 4:
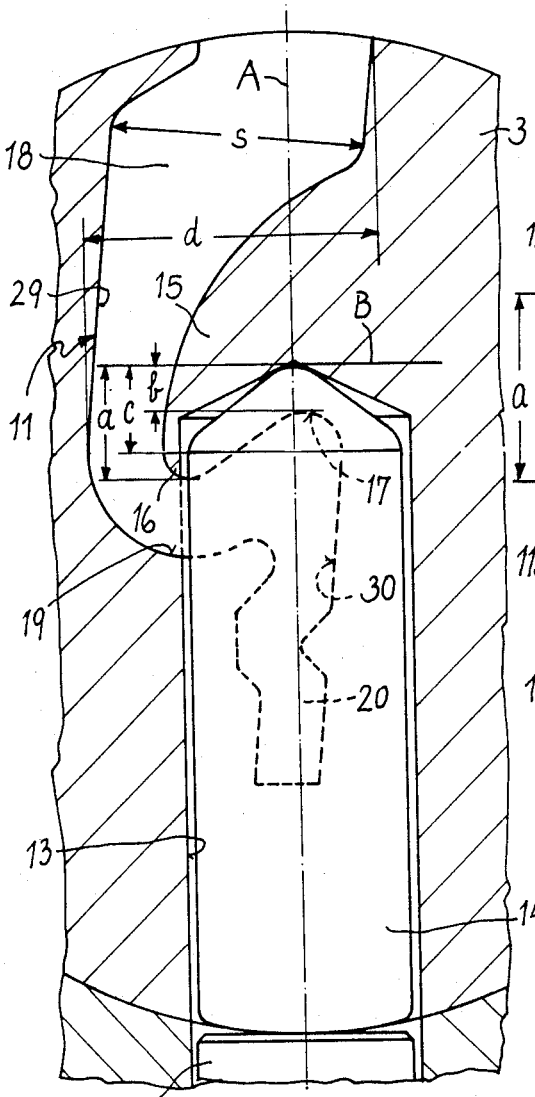
FIG. 4 is a fragmentary enlarged scale cross-sectional view of the cylinder lock according to the invention, taken in the plane IV—IV of FIG. 1.

The effectiveness of the inventive lock is immediately evident on a picking attempt. In fact, and as shown in FIG. 3, on inserting a picking tool 28 through the groove 17 between the pins 14 and rib 15, in an attempt to move the pins 14 downwardly to align the contact points of the pins 14 and the tumbler pins 9, with the shearing plane lying coincident with the surface of the plug 3, the pin 14*a* is unavoidably shifted into engagement with the hole 8 of the respective tumbler pin 9, thus inhibiting rotation of the plug.

It should also be noted that any lateral tampering with the pins 14 is prevented by the ridge 16 of the rib 15 concealing the conical ends of the pins 14 from view and thus rendering them inaccessible. In fact, the pins 14 can only be reached at the elbow 19 where their surfaces are cylindrical and unsuitable to provide a grip for a picking tool attempting to shift the pins.

A peculiar aspect of the invention is that the sidewalls of the slot 11, indicated at 29 and 30, are parallel to each other but slightly tilted on the centerplane A of the plug.

This configuration affords two substantial advantages. Firstly, it allows the key to be formed from sheet metal, the thickness dimension "s" (FIG. 4) thereof is equal to the distance separating the walls 29, 30, and hence, smaller than that which would be required if the walls were parallel to the centerplane A. In this case, in fact, considering that the key thickness cannot be made below certain limits to ensure adequate torque strength and that the back side and coding of the key are to be kept centered on the centerplane for symmetry reasons, a significantly greater thickness "d" would be required, which is obviously disadvantageous from the standpoint of economy of manufacture.

The sloping arrangement of the walls 29, 30 further facilitates formation of the key grooves, and in particular of the undercut to be engaged by the rib 15, by means of cutters having their rotation axes inclined on the key faces, and with substantially conventional techniques.

Figure 7:
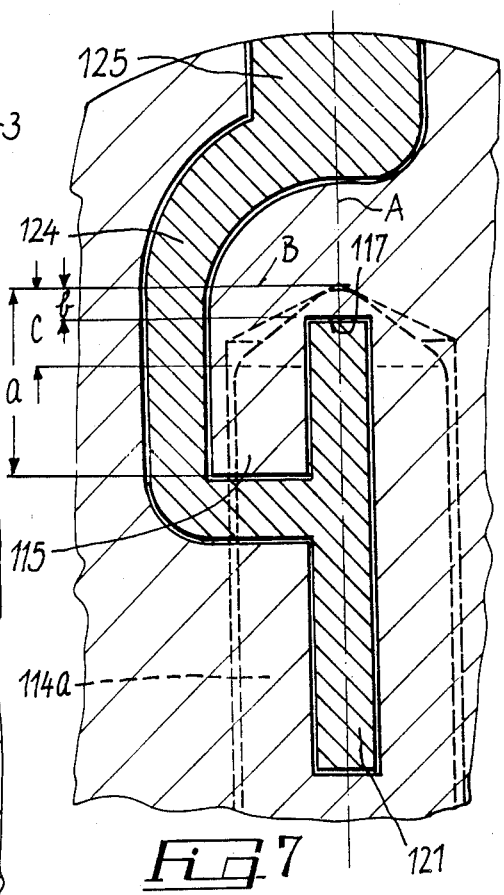
FIG. 7 is a sectional view through a differently coded profile key.
Figure 6:
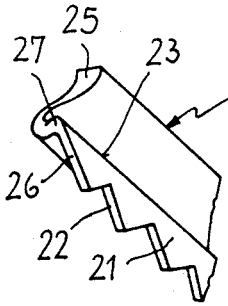
FIGS. 5 and 6 are two persective views showing the key for operating the cylinder lock of the preceding figures.
Figure 5:
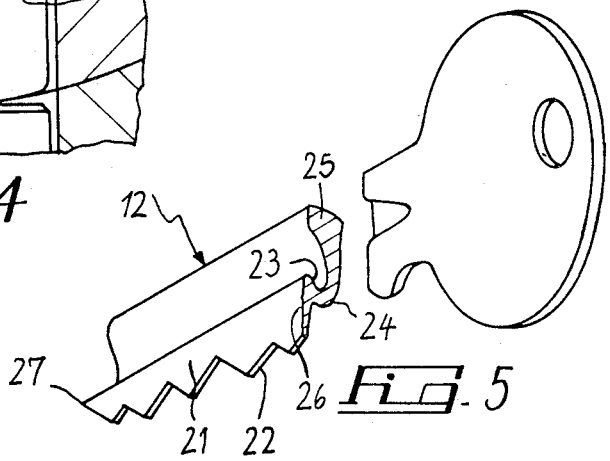

The invention may be modified and changed without departing from the purview of the instant inventive concept. For example, FIG. 7 shows a basic key profile formed by a drawing process, where the same elements or like parts as in the embodiment of FIGS. 1–6 are designated with the same reference numerals raised by 100. It should be noted, in particular, that the back side 125 is connected to the notched portion 121 by a web extending from approximately one half the height of the notched portion 121. This affords the possibility of providing the rib 115, with a ridge 117 extending upwardly therefrom and terminating at an extremity adapted to lie in a plane extending between the tip and the base of the conical ends of the pins 14, when inserted into the cylinder lock.

In practicing the invention, the materials, dimensions and contingent shapes may vary within the purview of the inventive concept.

I claim:

1. A cylinder lock comprising a lock cylinder, a cylindrical seat formed in said lock cylinder, a plug rotatably mounted within said cylindrical seat, a first set of holes formed in said plug on a radial plane and including cylindrical portions, pins slidably disposed in said first set of holes and having conical ends, one of said holes and the pin accommodated therein having the same length, a key slot longitudinally formed in said plug for receiving a key and intersecting said first set of holes, said key having a shank including a back side portion and a notched portion, a second set of holes formed in said lock cylinder, tumbler pins slidably arranged within said second set of holes and cooperating with said pins, a longitudinal rib laterally projecting into said key slot and forming a rest for said pins, said longitudinal rib defining a zone of said key slot adapted for receiving said back side portion of the key and a zone adapted for receiving the notched portion of the key, wherein said rib defines a ridge having a top and forming a groove, said ridge defining a portion of said key slot adjacent said top which connects said zones and intersects said cylindrical portions of said first set of holes and said groove having a bottom located substantially on said radial plane, through which said first set of holes penetrate into said rib.

2. A cylinder lock according to claim 1 wherein said first set of holes have a bottom, said bottom having a distance from the bottom of said groove which is smaller than the distance from the top of said ridge, and the conical ends of said pins defining a height dimension which lies between said distances.

3. A cylinder lock according to claim 1 wherein said portion of said key slot has the form of an arcuate elbow.

* * * * *